US009536503B2

(12) United States Patent
Deering

(10) Patent No.: US 9,536,503 B2
(45) Date of Patent: Jan. 3, 2017

(54) SIMPLIFIED BANJO AND DRUM BODY

(71) Applicant: Deering Banjo Company, Inc., Spring Valley, CA (US)

(72) Inventor: Charles Greg Deering, El Cajon, CA (US)

(73) Assignee: Deering Banjo Company, Inc., Spring Valley, CA (US)

( * ) Notice: Subject to any disclaimer, the term of this patent is extended or adjusted under 35 U.S.C. 154(b) by 0 days.

(21) Appl. No.: 14/819,169

(22) Filed: Aug. 5, 2015

(65) Prior Publication Data

US 2016/0042724 A1 Feb. 11, 2016

Related U.S. Application Data

(60) Provisional application No. 62/033,969, filed on Aug. 6, 2014.

(51) Int. Cl.

| | |
|---|---|
| ***G10D 1/00*** | (2006.01) |
| ***G10D 1/10*** | (2006.01) |
| ***G10D 3/00*** | (2006.01) |
| ***G10D 13/02*** | (2006.01) |

(52) U.S. Cl.
CPC *G10D 1/10* (2013.01); *G10D 3/00* (2013.01); *G10D 13/023* (2013.01)

(58) Field of Classification Search
CPC ..... G10D 1/10; G10D 3/02; G10D 1/00; G10D 13/027; G10D 13/028; G10D 3/14; G10H 2230/151
USPC ..... 84/269–272
See application file for complete search history.

(56) References Cited

U.S. PATENT DOCUMENTS 1,337,041 A * 4/1920 Cetta ..... G10D 1/10 84/269
8,816,176 B1 * 8/2014 Kunkel ..... G10D 3/02 84/269

* cited by examiner

*Primary Examiner* — Kimberly Lockett
(74) *Attorney, Agent, or Firm* — Richard D. Clarke

(57) ABSTRACT

The present invention is directed to a Simplified Banjo and Drum Body where the body section of the instruments will consist of an upper compression ring with grooves on the lower surface, a shell having mating compression grooves on the upper edge surface and the banjo head material. An optional tone ring can be added on the inner surface of the shell. The unique feature of this application is that when the compression ring is tightened down on the shell of the instrument the head material is automatically tightened over the instrument.

20 Claims, 4 Drawing Sheets

SIMPLIFIED BANJO AND DRUM BODY

FIELD OF THE INVENTION

This application deals with the manufacturing of banjos and drums with an economical and unique design for individuals who want to learn the basics of the instruments.

BACKGROUND OF THE INVENTION

The modern banjo includes a plurality of models, which includes the four-string version (plectrum and tenor), five-string versions, and even six-string versions. A typical banjo consists of neck section with frets, a tail piece or peg head with the body or pot having tensioning screws and shell, a tone ring, a rim and head. Typically, the head material is a membrane made of animal skin or a polymer like Mylar that is stretched across the generally circular Tone Ring, which in turn rests upon and is connected to the shell, which is normally made of wood. A cavity within the body of the banjo is called an "air chamber." The air chamber communicates to an outside of the banjo at a bottom portion of the shell.

Bodies of drums and banjos consist, usually, of three major concentric ringed portions which fit together under tension, as tightly as possible. Tensioning screws or brackets hold the components together and hold the head material in a stretched position. Since the quality and volume of the sounds from the instrument are directly related to the way these components fit against each other, it is critical that these components fit snugly together, with even pressure in all directions between all contacting surfaces.

Banjo manufacturers have tried to avoid the problem of imperfect fitting by substitution of a single piece part for the described components. However, this gives rise to a loss of desirable tone quality. As is well known in the trade, banjos are best made of different materials, shells of hard wood, while the contacting tone ring is best made of metal. Common problems of otherwise imperfect fitting were best resolved by excellent workmanship, tedious machine work, use of high quality materials, and well-seasoned wood. Obviously, all this is very expensive and results in a high cost of manufacture and a relatively high price to the consumer.

There is a growing need for economical simplified banjos and drums with similar characteristics that can be sold to beginning individuals who want to learn the basics of the instruments without making the large investment involved. This application describes a unique design that gives equal tension on the head material and a surprisingly good sound to the instrument.

Numerous innovations for the Simplified Banjo and Drum Body have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Simplified Banjo and Drum Body and the prior art.

U.S. Pat. No. 4,483,234 of Harry C. Snavely describes a banjo sub-assembly construction disclosed as well as a method of and an apparatus for assembling this sub-assembly of the banjo. The metal tone ring and mating wooden rim are fabricated with an interference fit so as to provide a tight and permanent interface there between and thereby enhance the quality and volume of sound from the banjo instrument.

A tone ring expander apparatus is used to expand the tone ring to permit the wooden rim to be easily inserted in the tone ring.

This patent describes a banjo sub-assembly construction as well as a method of and an apparatus for assembling this sub-assembly of the banjo. The metal tone ring and mating wooden rim are fabricated with an interference fit so as to provide a tight and permanent interface there between. This patent describes a conventional quality banjo and does not employ the unique upper compression ring with grooves on the lower surface or the shell having mating compression grooves on the upper edge surface to compress the head material when they are tightened together.

U.S. Pat. No. 3,921,492 of Geoffrey H. Stelling describes a banjo body assembly comprising, a cylindrical body shell having upper, mid- and lower wall portions, said shell having a downwardly sloping outer surface on the upper portion of said shell, a tone ring having at least one lower internal surface beveled to wedgingly mate with said outwardly sloping surface when said ring is placed on said shell, and a ring-shaped shell flange having an inner surface at least a portion of which wedgingly mates with a sloping outer surface of the mid-portion of said shell.

This patent describes a banjo body assembly but does not employ the unique upper compression ring with grooves on the lower surface or the shell having mating compression grooves on the upper edge surface to compress the head material when they are tightened together.

U.S. Pat. No. 4,928,565 of Wu H. Hsieh describes a musical drum with a drum face, a wooden drum body and a buffer element. The buffer element is situated between the drum face and the drum body. The drum face includes a drumhead and a rim for clamping the drumhead across the buffer element by way of clamping screws. The pressure exerted by the drum head on the buffer element is absorbable by the buffer element.

This patent describes a musical drum with a drum face, a wooden drum body and a buffer element. The buffer element is situated between the drum face and the drum body. The drum face includes a drumhead and a rim for clamping the drumhead across the buffer element but does not employ the unique upper compression ring with grooves on the lower surface or the shell having mating compression grooves on the upper edge surface to compress the head material when they are tightened together.

U.S. Pat. No. 4,869,146 of Clive W. L. Bonsor describes a musical drum that is disclosed having an outer cage to which both top and bottom counterhoops are connected in an independently adjustable manner. An intermediate hoop is provided between the top and bottom counterhoops to which a plurality of adjusting bolt assemblies for the top and bottom counterhoops are connected. The adjusting bolt assemblies for the bottom counterhoop are circumferentially offset with respect to the adjusting bolt assembles for the top counterhoop.

This patent describes a musical drum that is disclosed having an outer cage to which both top and bottom counter hoops are connected in an independently adjustable manner. This patent does not employ the unique upper compression ring with grooves on the lower surface or the shell having mating compression grooves on the upper edge surface to compress the head material when they are tightened together.

U.S. Pat. No. 7,465,86 of Anthony Passafiume describes a rim of the type used in a resonator banjo having a body that includes a head, a resonator, a tone ring and a flange for securing the head and the tone ring to the banjo, where the rim includes a generally circular housing having an inner circumference and an outer circumference, a top end and a bottom end, wherein the top end is configured to engage the tone ring, an annular shoulder portion extending around the outer circumference for engaging the flange, and an arcuate recess located below the top end and extending along, at least a portion of the inner circumference This patent describes a rim of the type used in a resonator banjo but does not employ the unique elements of the Simplified Banjo and Drum Body.

None of these previous efforts, however, provides the benefits attendant with the Simplified Banjo and Drum Body. The present design achieves its intended purposes, objects and advantages over the prior art devices through a new, useful and unobvious combination of method steps and component elements, with the use of a minimum number of functioning parts, at a reasonable cost to manufacture, and by employing readily available materials.

SUMMARY OF THE INVENTION

The principle advantage of the Simplified Banjo and Drum Body is to create an economical instrument that can be sold to beginning individuals who want to learn the basics of the instruments.

Another advantage of the Simplified Banjo and Dunn Body is having an upper compression ring with grooves on the lower surface.

Another advantage of the Simplified Banjo and Drum Body is having a shell with mating compression grooves on the upper edge surface.

Another advantage of the Simplified Banjo and Drum Body is that when the compression ring is tightened down on the shell of the instrument the head material is automatically tightened.

Another advantage Simplified Banjo and Drum Body is the unique application of both tightening and securing the head material in the same operation.

Another advantage of the Simplified Banjo and Drum Body is the replacement of the expensive seasoned woods with either inexpensive fiberglass or polymer materials.

Another advantage of the Simplified Banjo and Drum Body is having the option of using a metal tone ring or nor using the tone ring.

Another advantage of the Simplified Banjo and Drum Body is the replacement of the machined tone ring with a flat band of steel.

The Simplified Banjo and Drum Body application applies to the banjo consisting of a conventional neck section with frets, and a peg head with string tensioning mechanisms. The major differences from the conventional banjo are in the area of the body or pot section that is similar in construction to the proposed drum in this application.

The body section will consist of an upper compression ring with grooves on the lower surface, a shell haying mating compression grooves on the upper edge surface and the head material. The hardware materials used to tighten the upper compression ring to the shell of the instrument will be a plurality of button head or flat head screws with nuts imbedded into the shell, or button head or flat head screws threaded into a metal insert or flathead wood screws when a wood or composition shell is used in the manufacturing process. The unique feature of this application is that when the compression ring is tightened down on the shell of the instrument, the head material is automatically tightened.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Simplified Banjo and Drum Body. Further, since numerous modifications and changes will readily occur to those skilled in the art, it is not desired to limit the design to the exact construction and operation shown and described, and accordingly, all suitable modifications and equivalents may be resorted to, falling within the scope of this application. Additional features of the design will be described hereinafter which form the subject of the claims of this disclosure.

BRIEF DESCRIPTION OF THE DRAWINGS

The accompanying drawings, which are incorporated in and form a part of this specification, illustrate embodiments of the Simplified Banjo and Drum Body and together with the description, serve to explain the principles of this application.

For a fuller understanding of the nature and advantages of the Simplified Banjo and Drum Body reference should be had to the following detailed description taken in conjunction with the accompanying, drawings which are incorporated in and form a part of this specification, illustrate embodiments of the design and together with the description, serve to explain the principles of this application.

DETAILED DESCRIPTION OF THE PREFERRED EMBODIMENTS

Figure 1:
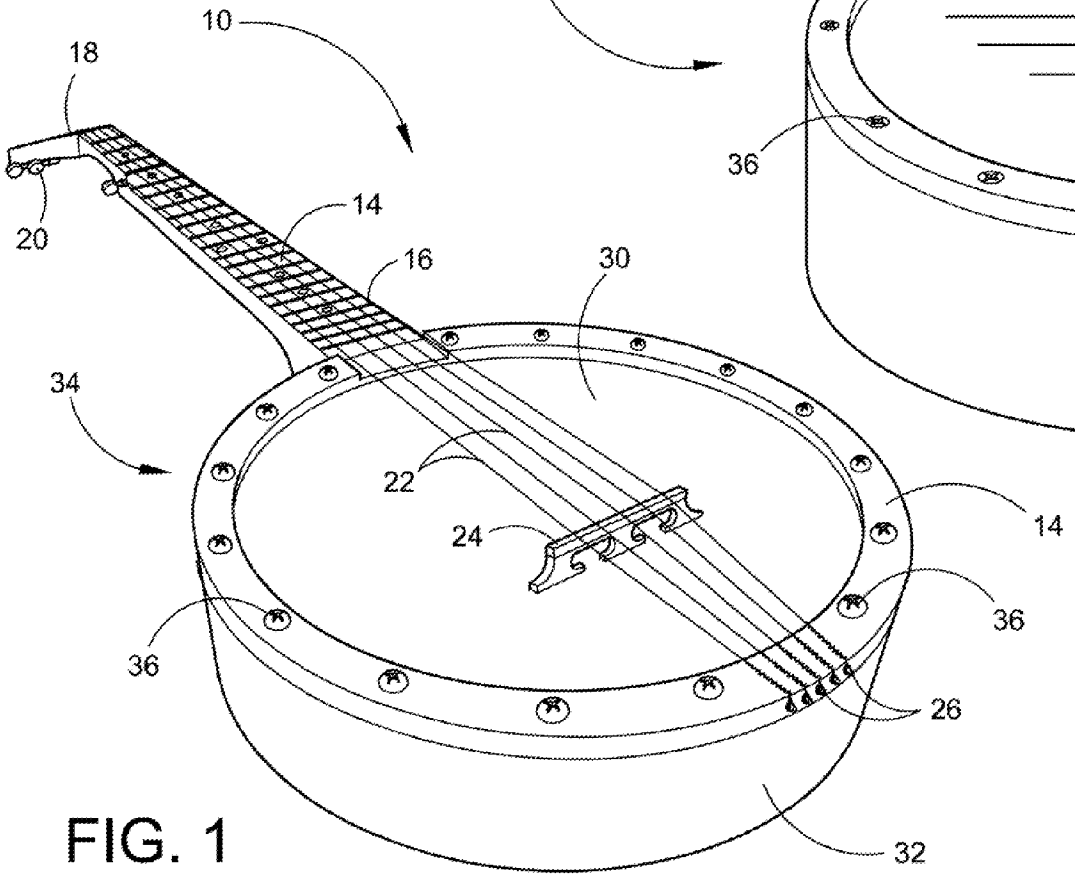
FIG. 1 depicts a perspective view of the Simplified Banjo.

Referring now to the drawings, wherein similar parts of the Simplified Banjo 10 and Drum Body 12 are identified by like reference numerals, there is seen in FIG. 1 a perspective view of the simplified banjo 10 with the conventional neck section 14 frets 16, a peg head 18 and string tensioning mechanisms. 20. The banjo stings 22 extend from the peg head 18 over the frets 16 and then over the bridge 24 to be attached to the string pins 26 that are attached to the upper compression ring 28. The banjo head material 30 is compressed between the upper compression ring 28 and the shell 32 comprising what is called the banjo body 34. A plurality of button head screws 36 are illustrated compressing. the banjo head material 30 between the upper compression ring 28 and the shell 32 of the banjo.

Figure 2:
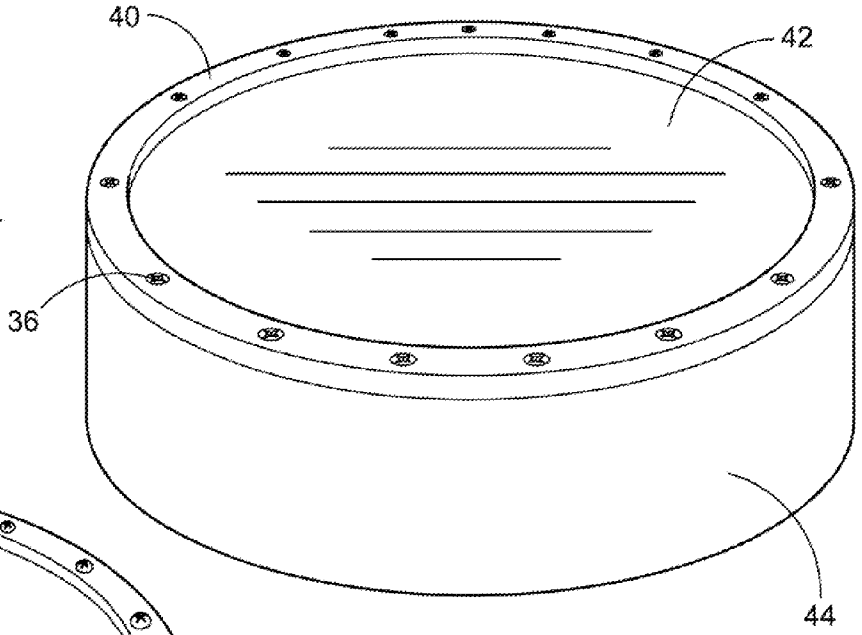
FIG. 2 depicts a perspective view of the Simplified Drum.

FIG. 2 depicts the simplified drum body 12 constructed with similar materials being an upper compression ring 40 with a plurality of button head screws 36 compressing the drum head material 42 to the shell 44.

Figure 3:
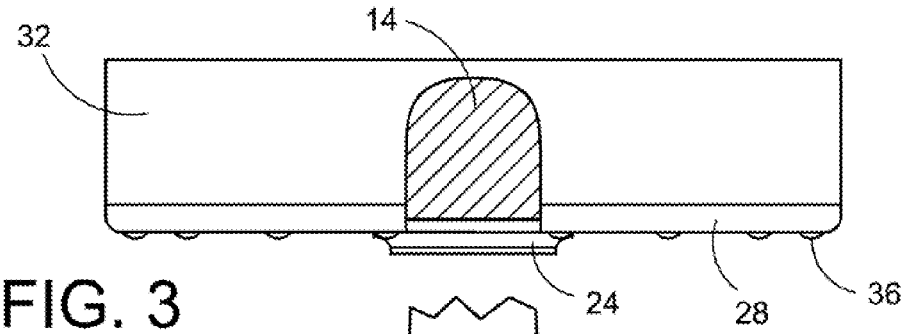
FIG. 3 depicts a rear end view through the neck of the banjo.

FIG. 3 depicts a rear end view of the banjo 10 through the neck section 14 of the banjo body 34 with the shell 32, upper compression ring 28, the bridge 24 and the button head screws 36. The banjo 10 may be constructed using the button head screws 36 (see FIG.'s 8 and 11), flat head screws (see FIGS. 9 and 12), or conventional wood screws (see FIG. 10). All of the screw fasteners may be driven in by one or more tools having either slot head, Philips head, torx head, hex head, or any other suitable drives.

Figure 4:
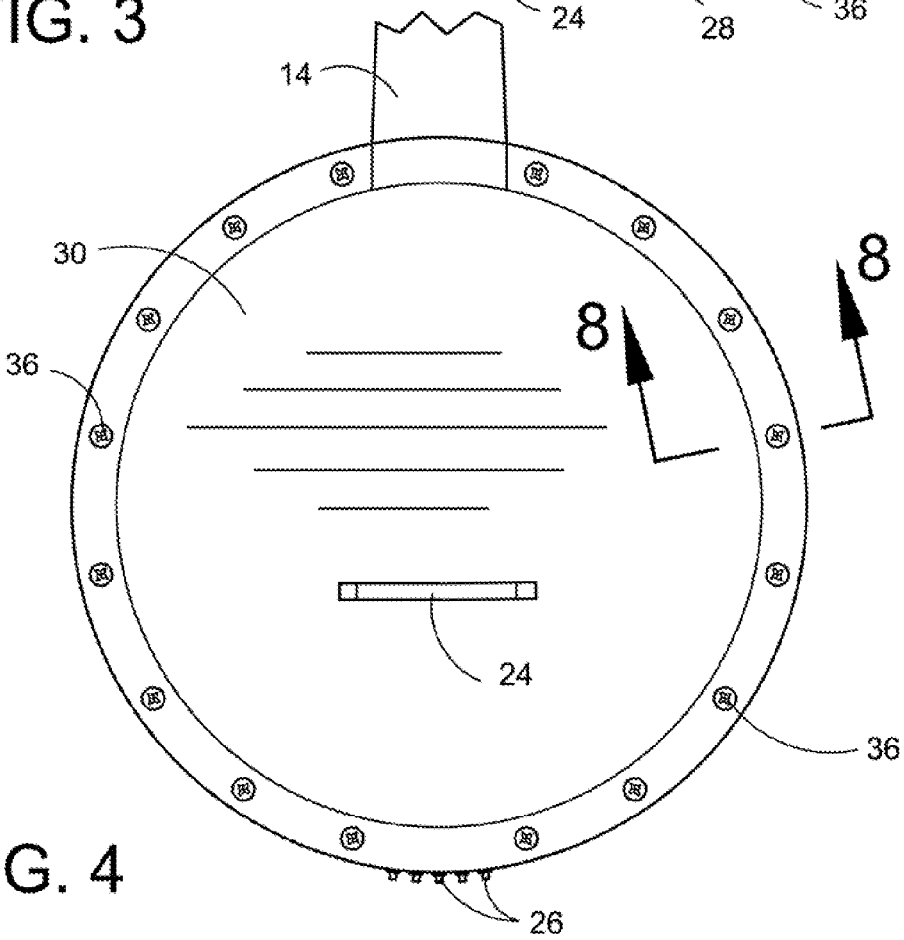
FIG. 4 depicts a top plan view of the banjo's body.

FIG. 4 depicts a top plan view of the banjo body 34 illustrating the upper compression ring 28 with the plurality of button head screws 36, the bridge 24 on the banjo head material 30 with string pins 26 attached to the front end of the upper compression ring 28.

Figure 5:
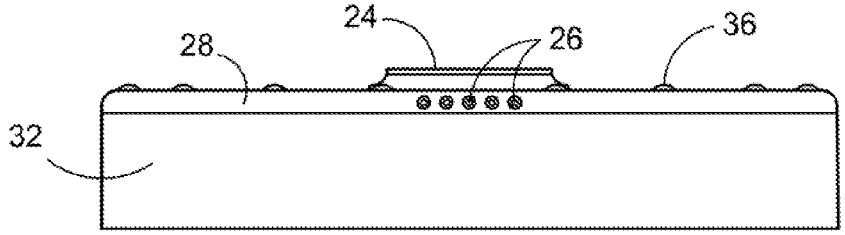
FIG. 5 depicts a front end view of the banjo's body.

FIG. 5 depicts a front end view of the banjo body 34 with the plurality of button head screws 36 attached to the upper compression ring 28, the bridge 24 and string pins 26.

Figure 6:
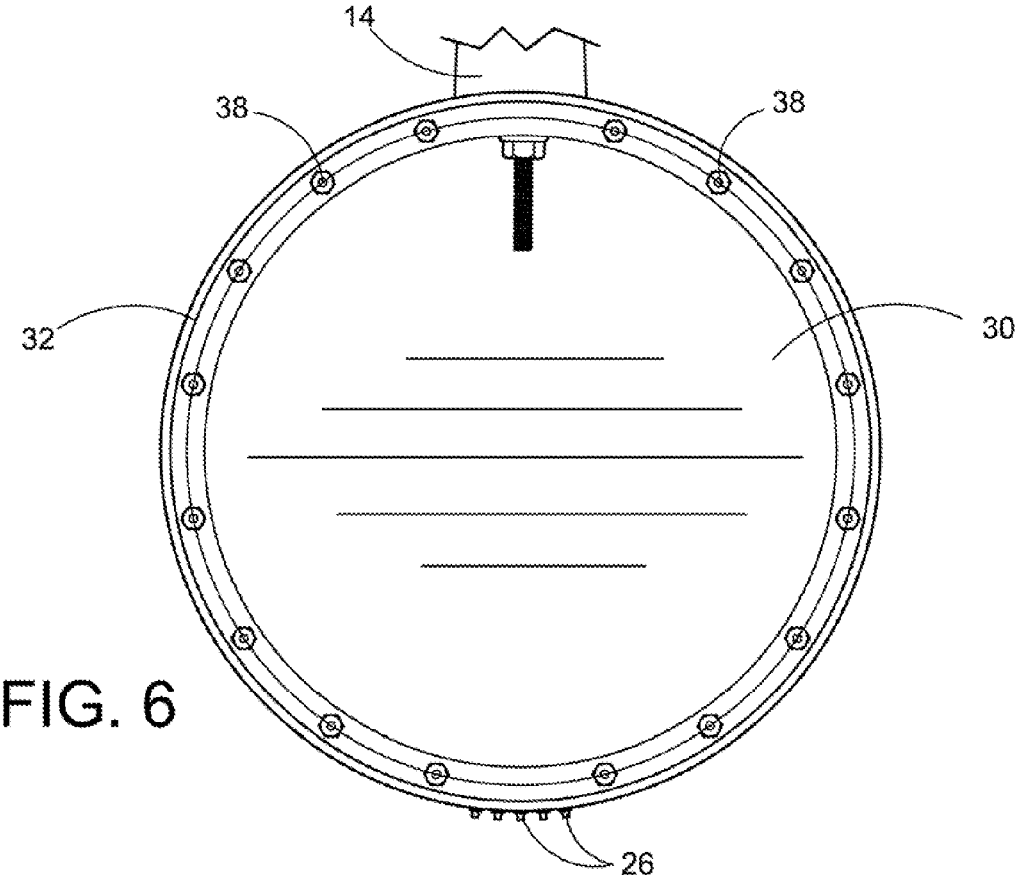
FIG. 6 depicts a bottom view of the banjo's body.

FIG. 6 depicts a bottom view of the banjo body 34 with the plurality of imbedded hex nuts 38, the banjo head material 30 and string pins 26.

Figure 7:
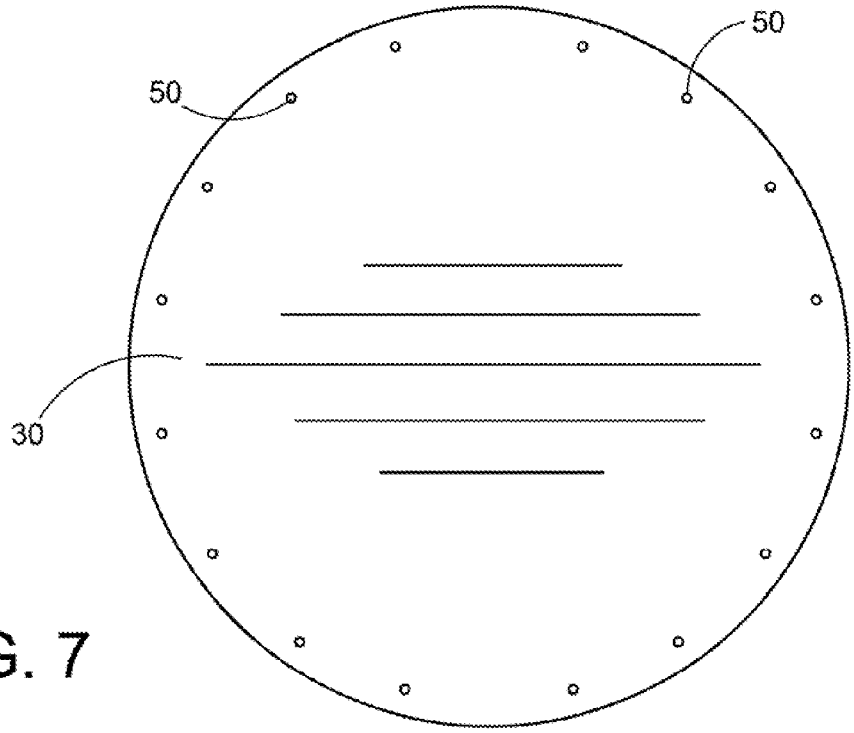
FIG. 7 depicts a top view of the banjo head material with the plurality of holes.

FIG. 7 depicts a top view of the banjo head material 30 with the plurality of holes 50.

Figure 8:
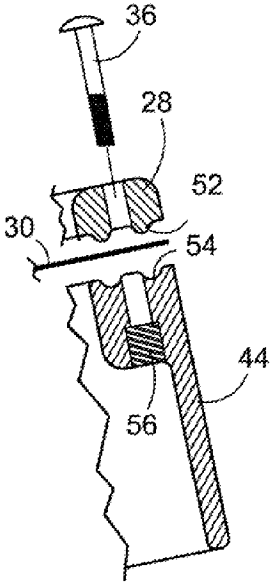
FIG. 8 depicts an exploded section through the side of the banjo body with the head material between the upper compression ring having grooves and the shell having mating compression grooves with a button head screw and threaded insert.

FIG. 8 depicts an exploded section through the side of the banjo body 34 with the banjo head material 30 between the upper compression ring 28 having grooves 52 and the shell 44 having mating compression grooves 54 with a button head screw 36 and threaded insert 56.

Figure 9:
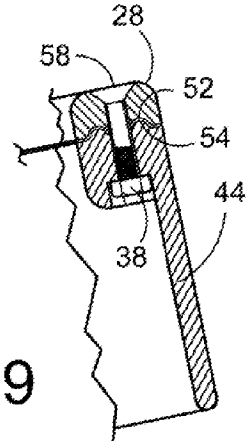
FIG. 9 depicts an assembled view of the site of the banjo body with the head material between the upper compression ring having grooves and the shell having mating compression grooves with a flat head screw with nuts imbedded in the shell.

FIG. 9 depicts an assembled view of the side of the banjo body 34 with the head material 30 between the upper compression ring 28 having grooves 52, the shell 44 with mating grooves 54, a flat head screw 58 and imbedded hex nut 38 in the shell 32.

Figure 10:
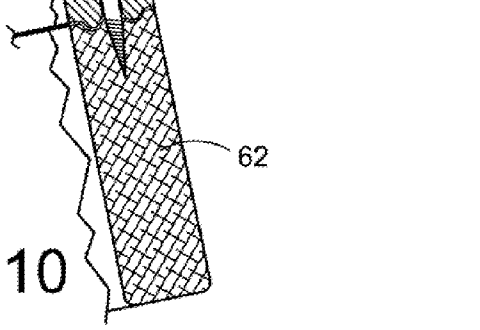
FIG. 10 depicts an assembled view of the side of the banjo body with the head material between the upper compression ring having grooves and the shell having mating compression grooves held together by the means of a wood screw into a wooden shell of the body.

FIG. 10 depicts an assembled view of the side of the banjo body 34 with the banjo head material 30 between the upper compression ring 28 having grooves 52 and the shell 44 having mating grooves 54 being held together by the means of a flat head wood screw 60 into a wooden or composition shell 62.

Figure 11:
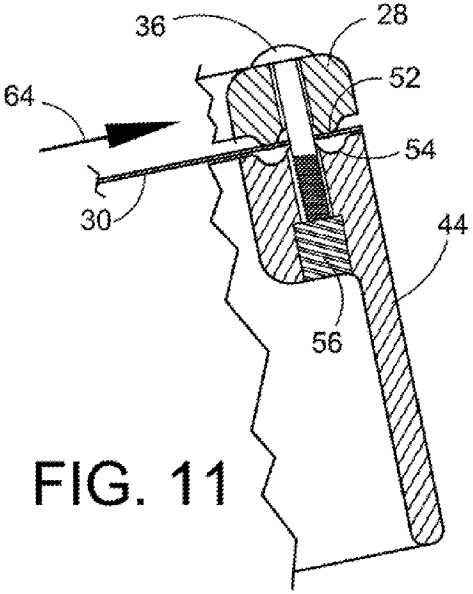
FIG. 11 depicts an enlarged view of the side of the banjo body indicating the stress put on the head material when the upper compression ring and the shell are tightened together.

FIG. 11 depicts an enlarged view of the side of the banjo body 34 indicating the stretching force 64 put on the banjo head material 30 when the upper compression ring 28 and the shell 44 are tightened together.

Figure 12:
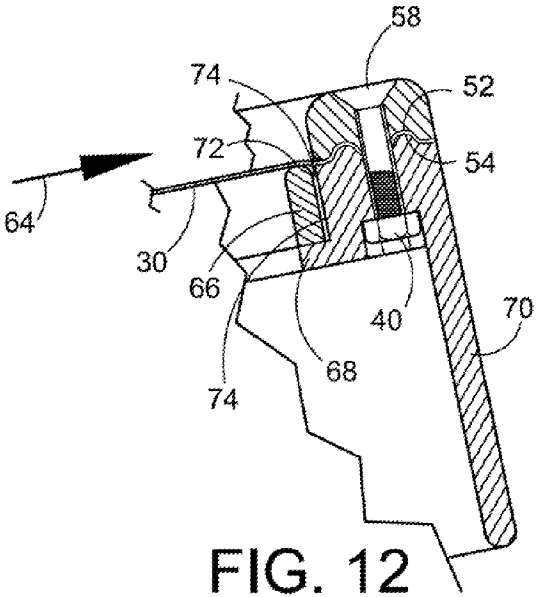
FIG. 12 depicts an enlarged view of the side of the banjo body indicating the addition of an optional tone ring.

FIG. 12 depicts an enlarged view of the side of the banjo body 34 indicating the addition of an optional tone ring 66 held in place by the means of the shoulder 68 incorporated in the shell 70. To function properly for improving the sound quality the radius end 72 of the tone ring 66 raises the banjo head material 30 while the tone ring 66 maintains a clearance 74 from the shell inner wall 46.

The Simplified Banjo 10 and Drum Body 12 shown in the drawings and described in detail herein disclose arrangements of elements of particular construction and configuration for illustrating preferred embodiments of structure and method of construction of the present application. It is to be understood, however, that elements of different construction and configuration and other arrangements thereof, other than those illustrated and described may be employed for providing a Simplified Banjo 10 and Drum Body 12 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A simplified banjo and drum body comprising:

(a) a stretchable banjo or drum head material;

(b) an upper compression ring having an upper surface and a lower surface, including grooves located on said upper compression ring lower surface;

(c) a shell having an upper edge surface and a lower edge surface including mating compression grooves located on said upper edge surface of said shell; and (d) a plurality of fasteners imbedded into said shell used to tighten said upper compression ring to said shell;

wherein when said banjo or drum material is positioned between upper compression ring and said shell, and said plurality of fasteners imbedded into said shell used to tighten said upper compression ring to said shell are tightened down, said upper compression ring is tightened down on said shell, and said banjo or drum head material is stretched between said grooves on said upper compression ring and said mating compression grooves on said shell, and thereby tightened.

2. The simplified banjo and drum body according to claim 1, wherein said upper compression ring includes string pins attached thereto.

3. The simplified banjo and drum body according to claim 1, wherein said plurality of fasteners include button head screws.

4. The simplified banjo and drum body according to claim 3, wherein said plurality of fasteners include button head screws whereby said button head screws are threaded into a metal insert having mating threads.

5. The simplified banjo and drum body according to claim 1, wherein said plurality of fasteners include flat head screws.

6. The simplified banjo and drum body according to claim 5, wherein said plurality of fasteners include flat head screws whereby said flat bead screws are threaded into a metal insert having mating threads.

7. The simplified banjo and drum body according to claim 5, wherein said plurality of fasteners include flat head screws whereby said flat head screws are threaded into a bolt having mating threads.

8. The simplified banjo and drum body according to claim 1, wherein said plurality of fasteners include conventional wood screws.

9. The simplified banjo and drum body according to claim 7, wherein said conventional wood screws are threaded directly into the shell material.

10. The simplified banjo and drum body according to claim 1, wherein said shell having an upper edge surface and a lower edge surface including mating compression grooves on said upper edge surface of said shell, is constructed of metal, synthetic composite material, plastic and wood.

11. A method for making a simplified banjo and drum body comprising the steps of:

(a) providing a stretchable banjo or drum head material;

(b) providing an upper compression ring having an upper surface and a lower surface, including grooves located on said upper compression ring lower surface;

(c) providing a shell having an upper edge surface and a lower edge surface including mating compression grooves located on said upper edge surface of said shell; and (d) providing a plurality of fasteners imbedded into said shell used to tighten said upper compression ring to said shell;

wherein when said banjo or drum material is positioned between upper compression ring and said shell, and said plurality of fasteners imbedded into said shell used to tighten said upper compression ring to said shell are tightened down, said upper compression ring is tightened down on said shell, and said banjo or drum head material is stretched between said grooves on said upper compression ring and said mating compression grooves on said shell, and thereby tightened.

12. The method for making a simplified banjo and drum body according to claim 11, wherein said upper compression ring includes string pins attached thereto.

13. The method for making a simplified banjo and drum body according to claim 11, wherein said plurality of fasteners include button head screws.

14. The method for making a simplified banjo and drum body according to claim 13, wherein said plurality of fasteners include button head screws whereby said button head screws are threaded into a metal insert having mating threads.

15. The method for making a simplified banjo and drum body according to claim 11, wherein said plurality of fasteners include fiat head screws.

16. The method for making a simplified banjo and drum body according to claim 15, wherein said plurality of fasteners include flat head screws whereby said flat head screws are threaded into a metal insert having mating threads.

17. The method for making a simplified banjo and drum body according to claim 15, wherein said plurality of fasteners include flat head screws whereby said flat head screws are threaded into a bolt having mating threads.

18. The method for making a simplified banjo and drum body according to claim 11, wherein said plurality of fasteners include conventional wood screws.

19. The method for making a simplified banjo and drum body according to claim 18, wherein said conventional wood screws are threaded directly into the shell material.

20. The method for making a simplified banjo and drum body according to claim 11, wherein said shell having an upper edge surface and a lower edge surface including mating compression grooves on said upper edge surface of said shell, is constructed of metal, synthetic composite material, plastic and wood.

* * * * *